United States Patent [19]

Plumettaz et al.

[11] 4,309,023

[45] Jan. 5, 1982

[54] SUSPENSION APPARATUS FOR A SCAFFOLD

[75] Inventors: Gerard Plumettaz, Bex; Joe Küpfer, Opfikon, both of Switzerland

[73] Assignees: Plumettaz S.A., Vaud; Gebr. Küpfer, Zurich, both of Switzerland

[21] Appl. No.: 76,315

[22] Filed: Sep. 17, 1979

[30] Foreign Application Priority Data

Sep. 25, 1978 [EP] European Pat. Off. ..... 78200205

[51] Int. Cl.[3] ..... B66D 1/52; B66D 1/58

[52] U.S. Cl. ..... 254/273; 254/286; 254/299; 182/36

[58] Field of Search ..... 254/267, 272, 273, 276, 254/283, 286, 295, 304, 306, 310, 321, 299; 182/36; 242/56.9

[56] References Cited

U.S. PATENT DOCUMENTS

| | | | |
|---|---|---|---|
| 3,263,965 | 8/1966 | Mutch | 254/286 |
| 3,462,125 | 8/1969 | Gollwitzer et al. | 254/273 |
| 3,606,257 | 9/1971 | Wilson | 254/273 |
| 3,776,368 | 12/1973 | Brauss | 182/19 |
| 3,834,673 | 9/1974 | Alexander | 254/295 |
| 4,140,287 | 2/1979 | Hutzenlaub | 242/56.9 |

FOREIGN PATENT DOCUMENTS

| | | |
|---|---|---|
| 1883998 | 4/1963 | Fed. Rep. of Germany . |
| 1234957 | 8/1967 | Fed. Rep. of Germany . |

*Primary Examiner*—Peter Feldman

*Attorney, Agent, or Firm*—Stevens, Davis, Miller & Mosher

[57] ABSTRACT

Apparatus for suspending a scaffold or the like, used for working on the outer walls of buildings, comprising a capstan made up of four pairs of pulleys driven by an electric motor. The pulleys have grooves for receiving suspension cables, each of which is wound over a pair of pulleys in five turns. On the slack-portion side, each cable is guided over a traverse mechanism, then runs onto a reel mounted via friction couplings on a shaft. This shaft is driven by the motor when the scaffold is raised, while during the descent it is locked by a monodirectional coupling, a driving wheel then being free on the shaft. A safety release device intended to intervene in case of lessening of the tractive force yielded by the friction couplings is combined with the traverse mechanism. If the tension of the slack portion of cable drops below a given threshold, a safety release cuts off the current supply to the motor and actuates an electromagnetic brake.

9 Claims, 6 Drawing Figures

Figure 1:
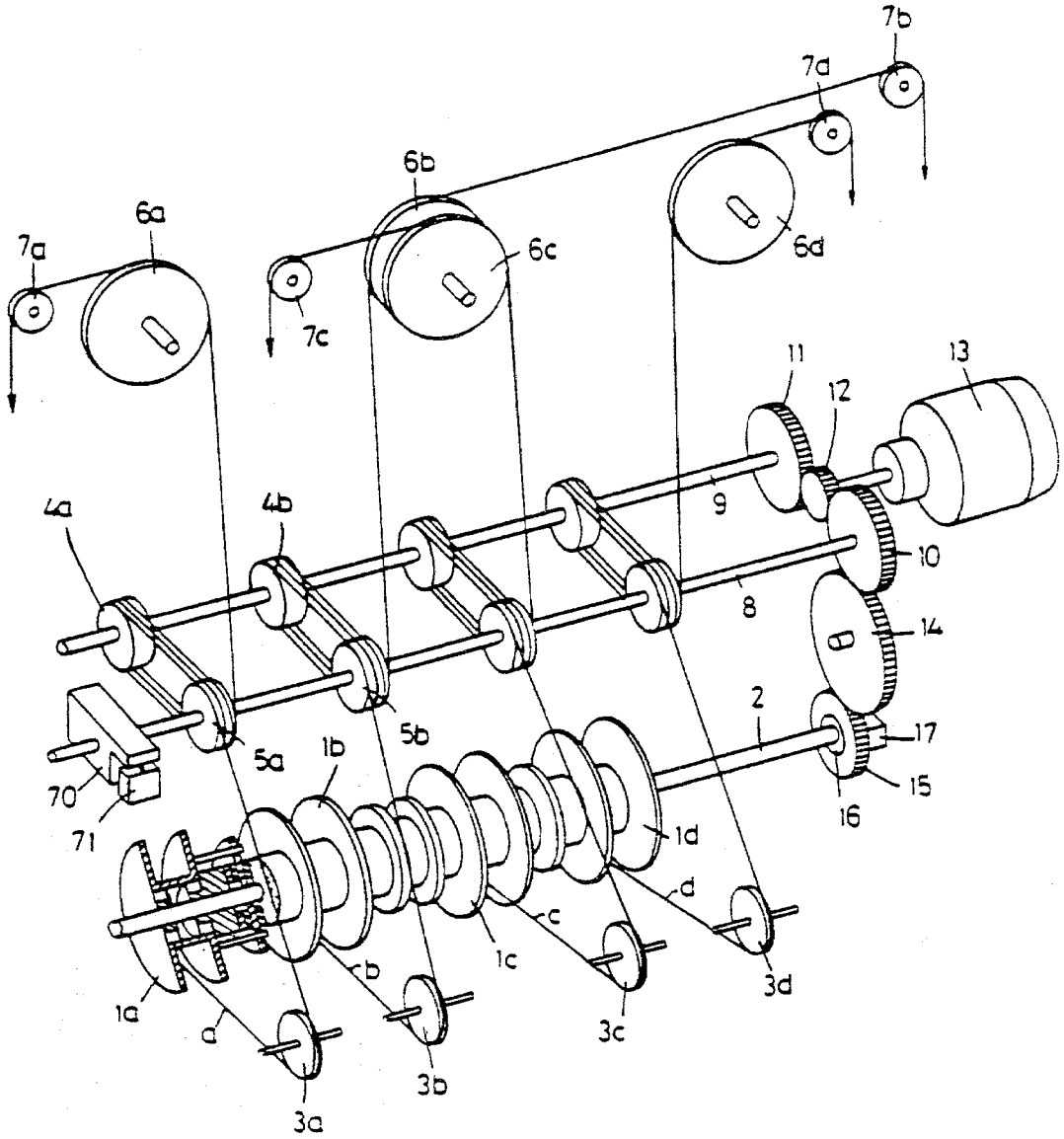

FIG. 5
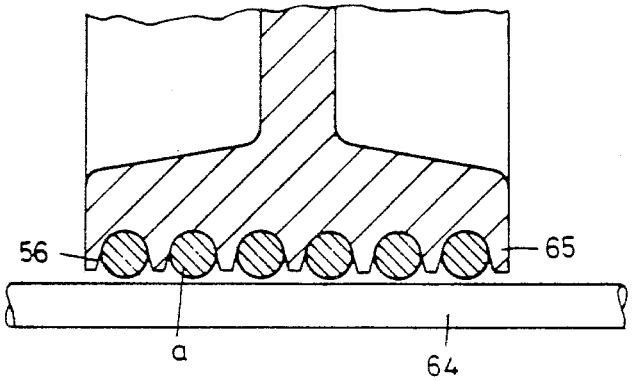
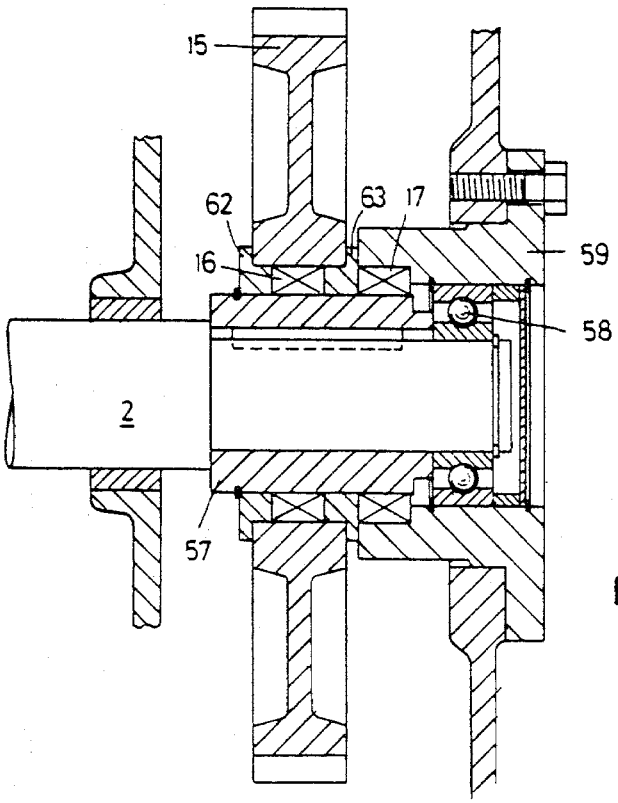
FIG. 6

SUSPENSION APPARATUS FOR A SCAFFOLD

This invention relates to apparatus for suspending a scaffold or working platform, which may be open or enclosed, and which is used for working on the outer walls of buildings, such apparatus being of the type in which at least one cable supporting the scaffold is connected to a support, such as a crane.

Numerous types of such suspension apparatus have already been proposed. In some cases, they comprise two or more pulleys between which the cable describes a figure-8 or S-shaped path. Such apparatus is relatively simple and light, but in order to be able to lock the cable, it is necessary to provide clamps, dogs, or jaws for pressing the cable against a locking element. Such apparatus therefore presents the great drawback of damaging the cable after a certain time. Other apparatus comprises a drum having a circular-grooved surface on which the cable reserve is wound. One end of the cable is secured to the drum, which is rotatingly driven by a control motor in one direction or the other, depending upon whether the scaffold is to be raised or lowered. Thus, the scaffold is connected to the support at a fixed point to which one end of the cable is attached, so that no jaws or cable-gripping members need be provided, and the risk of damage is avoided. However, such apparatus is extremely bulky, for the cable reserve must be laid down in a single layer on the drum, and this leads to extremely large-sized drums. The large size of the drum complicates the construction of the winch and increases its weight, and this can complicate the arrangement of the track provided at the top of the wall for displacing the support.

It is an object of this invention to remedy these various drawbacks by providing suspension apparatus of the type initially mentioned which is compact in size, can be installed either on the scaffold or in the movable support mounted at the top of the wall, easily holds long lengths of cable and consequently lends itself to installation on very high walls, and is both simple to handle and reliable in operation.

To this end, the invention makes use of the properties of winches made up of one or more pairs of multiple-groove pulleys on which a winding of several turns of wire makes possible a considerable reduction of the transmission of force between the taut portion and the slack portion of the cable. In devices of this kind, the presence of deep grooves holds the cable to the pulleys by simple friction, without squeezing or clamping or risk of damaging the cable.

In order to achieve the aforementioned object, the apparatus according to the present invention further comprises a winch composed of one or more pairs of grooved pulleys having parallel axes, a motor coupled to the winch for causing the pulleys to rotate in the same direction, each cable being wound several times over one of the pairs of pulleys and having on one side a taut portion running to the scaffold or to the support and on the other side a slack portion, means for keeping the slack portion under tension, means for monitoring the tension of the slack portion, and winch-locking means connected to the monitoring means so that the latter bring about the forced locking of the winch if the tension of the slack portion falls below a predetermined threshold.

Figure 2:
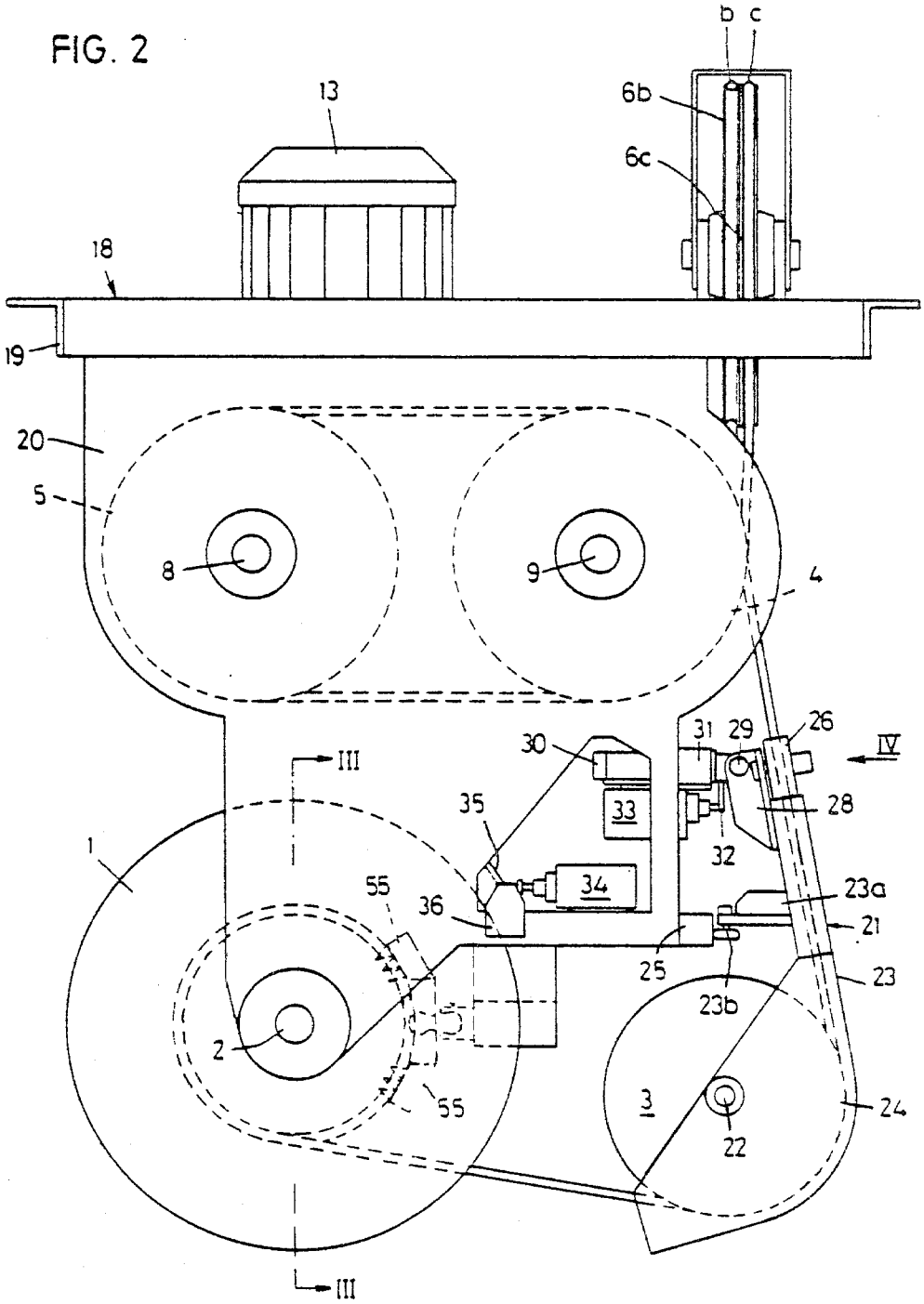
Figure 3:
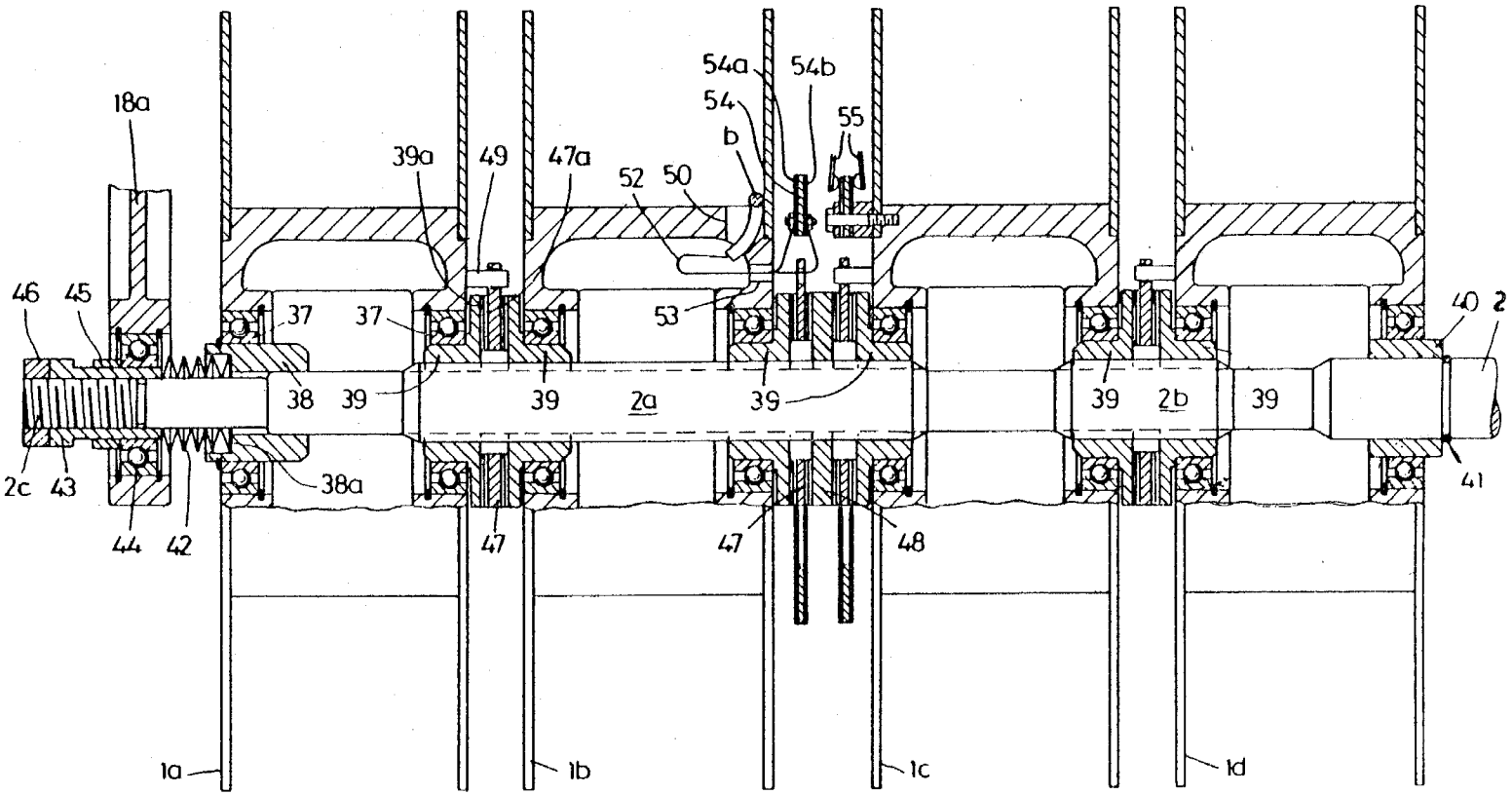
Figure 4:
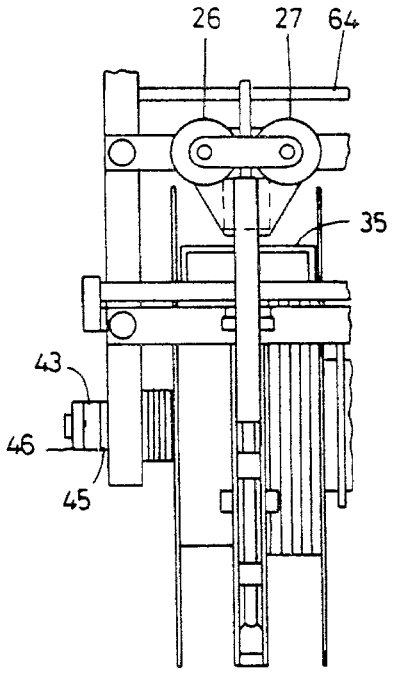

A preferred embodiment of the invention will now be described in detail with reference to the accompanying drawings, in which:

FIG. 1 is a diagrammatic perspective view showing the overall arrangement of the suspension apparatus, FIG. 2 is a side elevation, FIG. 3 is a sectional view through the axis of a reel-shaft, taken on the line III—III of FIG. 2, FIG. 4 is a partial elevation, partially in section, facing in the direction indicated by arrow IV in FIG. 2, FIG. 5 is a partial sectional view of the grooved cable-winding drums, and FIG. 6 is a sectional view showing the end of the reel-shaft and the free-wheel devices controlling it.

The suspension apparatus illustrated in the drawings is intended for four cables, two of which are scaffold-bearing cables and the other two safety cables. The apparatus may be placed either in a support situated at the top of an outer wall of a building or on a scaffold itself. The support and the scaffold are not shown in the drawings since they are already known per se. The support is known to comprise, in general, a carriage mounted on either tired-wheels or rails so that it can be moved along the top of the wall. It usually includes two rocker-arms equipped with pulleys guiding the cables. When the scaffold is raised all the way, the rocker arms can be pulled back so as to set the scaffold down on the roof of the building.

In the embodiment of the invention to be described below, the suspension apparatus comprises reels on which the cables are wound as the scaffold rises. It should be noted, however, that in other embodiments, the cable or cables might very well pass completely through the apparatus and then hang down slack along the face of the wall. Apparatus of this kind would be constructed with the winch mounted on the scaffold, which would therefore move up or down along the cable without any variation in the unwound length of the cable.

The general arrangement of the apparatus may be seen in FIG. 1. Four reels 1*a*, 1*b*, 1*c*, and 1*d* are mounted on a common shaft 2. Each of four cables a, b, c, and d starts from one of the reels 1 to which it is secured by means to be described below, passes over a traversing pulley 3*a*, 3*b*, 3*c*, 3*d*, then over a pair of pulleys 4*a*, 5*a*, 4*b*, 5*b*, etc., then over two successive idle pulleys 6*a*, 7*a*, 6*b*, 7*b*, etc., and thereafter runs toward the scaffold. Pulleys 4*a*, 5*a*, 4*b*, 5*b*, 4*c*, 5*c*, 4*d*, 5*d*, which constitute the winch, are mounted on two parallel shafts 8 and 9 which are also parallel to shaft 2, whereas the axes of idle pulleys 6*a*, 7*a*, 6*b*, 7*b*, 6*c*, 7*c*, 6*d*, 7*d*, are perpendicular to the axes of shafts 8 and 9. Shafts 8 and 9 each bear at one end a driving wheel 10, 11 engaging a pinion 12 driven by a motor 13. Driving wheel 10 also drives a counter-gear 14 engaging a wheel 15 which is slightly smaller in diameter than wheels 10 and 11, the latter two wheels being equal in diameter. Wheel 15 is connected to shaft 2 by a monodirectional coupling 16, which will be described in more detail below, so that when motor 13 rotates in the direction which causes the scaffold to rise, shaft 2 is driven at a slightly greater speed than shafts 8 and 9. Since friction couplings are provided between the respective reels 1*a*, 1*b*, 1*c*, 1*d* and shaft 2, each of the cables a, b, c, d is therefore drawn over the corresponding reel with a force corresponding to the torque of the friction.

When the scaffold moves downward, motor 13 is driven in the opposite direction from that which causes the scaffold to rise, and another monodirectional coupling 17 between the frame of the apparatus and shaft 2 prevents the latter from rotating, while wheel 15 turns freely about shaft 2. Cables a, b, c, d are unwound by the traction effect imparted to the slack portions of the cables by the torques of pulleys 4*a*, 5*a*, 4*b*, 5*b*, etc., for reels 1*a*, 1*b*, 1*c*, 1*d* are compelled by the traction exerted on the cables to rotate relative to shaft 2, which is stationary, the resistance torque corresponding to the maximum torque of the friction couplings.

Before going on to a description of the safety devices provided, the main elements of the apparatus will now be reviewed with reference to FIGS. 2, 5, and 6.

The overall design of the apparatus is shown in FIG. 2. The frame, designated as a whole by reference numeral 18, is made up of welded sections or assembled from cast parts. Secured to a frame portion 19 are end elements 20 carrying bearings of shafts 8, 9, and 2, respectively supporting pulleys 5, 4, and reels 1. Idle pulleys 6 and 7 are mounted directly on frame portion 19. FIG. 2 shows idle pulleys 6*c* and 6*b* with cables b and c. Here, motor 13 is disposed with its shaft vertical. This motor is equipped with a first wormgear, the wheel of which is rigidly coupled to pinion 12 (FIG. 1) which drives wheels 10 and 11, keyed on shafts 8 and 9, with a reduction on the order of 1:6. In this way, a reduction of 1:60 is easily obtained between the shaft of motor 13 and shafts 8 and 9.

FIG. 2 also shows the traverse mechanism, designated as a whole by reference numeral 21, which ensures that each of the cables is uniformly laid on the corresponding reel 1. Mechanism 21 comprises pulley 3, mounted loose on a shaft 22, and a rigid arm 23, at the end of which is a half-jacket 24 bearing shaft 22 and enclosing pulley 3. Arm 23 is connected to frame 18 by a double joint; a lateral bracket 23*a*, rigidly secured to arm 23, rests against a roller-track 25, integral with frame 18, by means of two rounded-profile rollers 23*b*. At the upper end of arm 23, the cable is guided between two rollers 26 and 27 ( see also FIG. 4) rotating on parallel spindles made integral with arm 23 via a bracket 28, the middle part of which is hinged about a pin 29 to a rod 30. This rod slides in a bearing 31, integral with frame 18; and seated between the rearward end of rod 30 and bearing 31 is a spiral spring (not shown) which continuously acts upon the rearward end of rod 30 and tends to displace joint 29 to the left, as viewed in FIG. 2. The front end of rod 30 is provided with a finger 32 extending immediately in front of a contact switch 33, likewise integral with frame 18. The cable passes through the tubular portion of arm 23 and heads from traversing pulley 3 toward the first pulley 4 of the winch. In the course of its travel, it causes arm 23 to pivot alternatingly about the axis of rod 30, which automatically leads to the laying of uniform layers of cable on the drum of reel 1. Therefore, as long as the cable—which passes into arm 23, over traversing pulley 3, and is wound on reel 1—is subjected to a certain tension, the spiral spring seated between elements 30 and 31 is kept slightly compressed, so that finger 32 does not press on switch 33. If, on the other hand, for one reason or another, the tension on the part of the cable passing through arm 23 should drop below a predetermined threshold, the bias of the spring predominates, so that rod 30 moves toward the left, as viewed in FIG. 2, and finger 32 actuates switch 33. At that moment, arm 23 pivots about the fulcrum formed by rollers 23*b* resting against track 25.

The member upon which switch 33 acts will become apparent below.

The presence of another safety switch, designated by reference numeral 34, will also be noted in FIG. 2. Switch 34 cooperates with a stirrup 35 hinged to a supporting plate 36. Stirrup 35 follows the piling up of the layers which form on reel 1 and causes switch 34 to be thrown when reel 1 is full.

Traverse mechanism 21, comprising pulley 3 and arm 23 which ensures that uniform layers of cable are laid on the drums of reels 1, has been described above. This mechanism, and more particularly the articulation about axis 30 described above, ensures that the layers are laid uniformly. When the arm has assumed an inclined position such that the cable is in the vicinity of one of the flanges of the reel, a reversal of the direction of tilt takes place automatically, and the following layer is laid on the reel with the arm swinging in the other direction.

Another important aspect of the present invention is the manner in which reels 1 are mounted on shaft 2. The details of these elements may be seen in FIG. 3. This figure shows the four reels 1*a*, 1*b*, 1*c*, 1*d*. The two outer reels 1*a* and 1*d* receive the two actual supporting cables, while reels 1*b* and 1*c* receive the safety cables. Shaft 2 is connected to driving pinion 15, and the way in which it is supported in bearings and coupled to that pinion will be described below. As may be seen in FIG. 3, shaft 2 includes enlarged portions 2*a* and 2*b* on which channeling has been milled. Reels 1*a*, 1*b*, 1*c*, and 1*d* are mounted on shaft 2 via ball bearings 37, two of which are associated with each reel, and via hubs 38, 39, and 40. Each reel 1 is supported by two ball bearings 37 on two hub elements. For inner reels 1*b* and 1*c*, the inner races of ball bearings 37 are mounted on L-profiled hub elements 39 having ribs within their inner bores, fitting into the grooves between the channeling of enlarged portions 2*a* and 2*b*. Hence hub elements 39, although longitudinally movable on enlarged portions 2*a* or 2*b*, are nevertheless rigidly coupled to shaft 2. As may be seen, for the two inner reels 1*b* and 1*c*, three of the hub elements 39 are mounted on enlarged portion 2*a*, while the remaining hub element 39 is mounted on enlarged portion 2*b*. For the two outer reels 1*a* and 1*d*, on the other hand, only one of the hub elements between one of the couplings and the shaft is a hub element of type 39 fitted on a portion 2*a* or 2*b*. The other hub element supporting each of the two outer reels is a smooth, tubular part. Hub element 40, supporting the end of reel 1*d*, is fitted on an enlarged portion of shaft 2 and abuts a stop ring 41 fitted into a groove of the shaft. It is ring 41 which determines the axial position of all the reels 1 on shaft 2. As for hub element 38 situated at the left-hand end of shaft 2, as viewed in FIG. 3, it likewise slides on a portion of shaft 2, the diameter of which is reduced to match the depth of the grooves in portions 2*a* and 2*b* so that reels 1 can be fitted on shaft 2 from the left-hand end thereof, as viewed in FIG. 3. At the left-hand end of hub element 38 there is a seat 38*a* into which a spring 42 is pressed by a socket 43 screwed on a thread 2*c* of the left-hand end of shaft 2.

Socket 43 fits into the inner ball-race of a bearing 44 supporting the left-hand end of shaft 2 and secured to the left-hand wall 20 of frame 18. A spacer ring 45 limits the displacement of socket 43 toward the right, while a check-nut 46 can lock it when it has been screwed tight.

Reverting to the six L-profile hub elements 39, each of them will be seen to present a face 39*a* perpendicular to the axis of shaft 2. Face 39*a* is in contact with an anti-friction coating 47*a* of a spacer ring 47 integral with a reel 1. Thus, each reel 1*a*, 1*b*, 1*c*, 1*d* cooperates with a friction device comprising a ring 47, coated on both sides with an anti-friction coating 47*a*. Disposed between reels 1*b* and 1*c* are two anti-friction rings 47, gripped between which is a flat ring 48 coupled rigidly to shaft 2 by the fitting of its profiled center hole to the channeling of enlarged portion 2*a*.

Each of the four gripping rings 47 is larger in diameter than the flanges of hub elements 39 and has along its outer periphery a series of round holes in which rods 49, projecting axially from each of the reels 1, are freely inserted. Thus, each spacer ring 47 is rigidly coupled to one of the reels 1*a*, 1*b*, 1*c*, or 1*d*. It will be realized that reels 1 are each coupled to shaft 2 by friction couplings produced between hub elements 39 or ring 48 and spacer rings 47. The frictional torque can be uniformly and equally adjusted for the four reels 1 by means of socket 43 screwed to the end of shaft 2. Spring 42 may be a spiral spring or an element made up of reinforced rubber disks or frusto-conical metal rings. This element must make it possible to adjust the frictional torque precisely in each of the couplings between shaft 2 and reels 1.

In FIG. 3, the end of cable b is seen on the drum of the corresponding reel 1*b*. This end is inserted in a hole 50 in the drum of reel 1*b*. The cables used may be metal cables provided with a conductive core of electrical conductors 52 which continue beyond the end of the cable, pass through a hole 53 in the drum of the reel, and are connected to conductive coatings 54*a*, 54*b* borne by insulating rings 54. Rings 54 are disposed in the same plane as two of the rings 47, being larger in diameter. Insulating ring 54 is secured to the drum of the corresponding reel 1 so that it rotates with that reel. Brushes 55, also shown in FIG. 2, connected to apparatus mounted on frame 18 by suitable support devices, make it possible to establish an electric connection between conductors 52 and control or alarm devices. Such means may be utilized both when the apparatus described is situated on the support at the top of the wall and and when it is situated on the scaffold itself. Checknut 46, as well as socket 43 and stop ring 45, are likewise shown in FIG. 4, where they are illustrated in the position of maximum thrust toward the right.

Two important elements remain to be described. First of all, it follows from what has been stated above that the tractive force is transmitted from motor 13 to the cable via pairs of pulleys 4*a*, 5*a*, 4*b*, 5*b*, etc., mounted on shafts 8 and 9. In order that these pulleys may transmit the forces reliably, their conformation must be carefully studied. FIG. 5 shows one of the pulleys 5*a* or 4*a*, 5*b* or 4*b*, 5*c* or 4*c*, 5*d* or 4*d* in partial section on a plane passing through the axis. In the outer face of a rim 65 of this pulley there are six grooves 56 disposed side by side. The profile of grooves 56 is not immaterial but must be adapted to the diameter of the cable. In FIG. 5, a cross-section through a section of cable a may be seen. The bottoms of grooves 56 are shaped as an arc of a circle concentric with the cable and having a radius slightly greater than that of the cable, while the sides of the grooves are slightly inclined. Since all the pulleys have the same diameter, the cables describe arcuate segments having an opening of 180° on each pulley. Because of the friction exerted on substantially half the periphery of the cable, an adequate transmission of force by friction is obtained between the pulleys and the cable. In order for this transmission to take place, it is naturally necessary for a minimum tractive stress to exist on the slack portion of the cable. This force being ensured by the friction couplings described above, it has been found in practice that with an arrangement such as that illustrated in FIG. 5, in which the cable is situated deep within circular-bottomed grooves and makes five turns over each pair of pulleys, sufficiently reliable transmission is obtained. Pulleys 4 and 5 are closely surrounded by cylindrical bars 64 (FIG. 5) which prevent the cables from leaving the grooves. One of these bars 64 is also shown in FIG. 4. The couplings between pulleys 4*a*, 5*a*, 4*b*, 5*b*, 4*c*, 5*c*, 4*d*, 5*d* and shafts 8 and 9 will be supported by ball bearings. It will be advantageous to provide at least one intermediate bearing between the pairs of pulleys 4*b*, 5*b*, and 4*c*, 5*c* and a bearing at the left-hand end of shafts 8 and 9, as well as two bearings embracing wheels 10 and 11 at the right-hand end of shafts 8 and 9. The result will be a rigid construction preventing vibration and capable of absorbing the stresses.

The drive ratios will be so selected that the peripheral speed at the drums of reels 1*a*–1*d* is slightly greater than the peripheral speed of grooved pulleys 4 and 5.

FIG. 6 shows the right-hand end of shaft 2, on which a tubular hub 57 and a ball bearing 58 are keyed. Bearing 58 supports shaft 2 in a fixed bearing housing 59 screwed to a flange forming part of frame 18. Bearing 58 also holds shaft 2 in place axially; and as may be seen in FIG. 6, tubular sleeve 57 is gripped between a shoulder of shaft 2 and the side of bearing 58. Moreover, coupling 17 of the free-wheel or monodirectional type is provided between bearing housing 59 and tubular sleeve 57. Coupling 17, e.g., a roller coupling of a type known per se, is mounted on tubular sleeve 57 within the left-hand end, as viewed in FIG. 6, of bearing housing 59. This coupling allows shaft 2 to rotate only in the direction corresponding to the rise of the scaffold and locks shaft 2 as soon as rotation in the opposite direction starts.

Tubular sleeve 57 centers and guides drive wheel 15, which is connected to shaft 2 via monodirectional coupling 16 and two guiding support rings 62 and 63. Wheel 15 can rotate freely relative to support rings 62 and 63 in the direction in which shaft 2 is locked, whereas upon rotation in the opposite direction, wheel 15 drives tubular sleeve 57 and shaft 2 owing to coupling 16. When the scaffold descends, motor 13 drives wheels 10 and 11 in the direction which brings about the unwinding of the cables on reels 1. In this case, wheel 15 turns freely on supports 62 and 63 and on coupling 16, while shaft 2 is locked. Reels 1*a*, 1*b*, 1*c*, 1*d* are rotated by the traction of cables a, b, c, and d, and they ensure restraint by means of a torque corresponding to friction assembly 47, 39, 48.

Owing to these elements, the movements of the scaffold and its suspension are ensured in a completely reliable manner and without any risk of damage to the cables due to the multiplication of effort achieved by the pairs of pulleys 4 and 5 with their deep grooves in which the cables are closely guided. The force necessary on the slack portion of cable is provided by the friction couplings. When the scaffold is raised, shaft 2 drives elements 39 and 48 faster than reels 1, the speed of which is that imparted by pulleys 4 and 5; whereas during the descent, the restraining force is due to the fact that shaft 2 is locked, so that reels 1 are rotated by the cables and cause rings 47 to slip between elements 39 and 48.

As a safety device, elements must be provided which prevent any catastrophic consequences which might result, for example, if shafts 8 and 9 should be released and could run idle. In order to prevent this, an electromagnetic brake on motor 13 is provided on the one hand, and a safety locking device 70, schematically illustrated in FIG. 1, on the other hand. Device 70 comprises a shoe mounted on shock absorbers, cooperating with rollers which are moved into braking position by centrifugal force if the speed of shafts 8 and 9 increases beyond a certain limit. Brake 70 is connected to a safety switch 71 which likewise cuts off the current supplied to motor 13. Thus, in the event of racing because, for instance, a phase drops out, not only does safety brake 70 act upon shaft 8 to lock it, but the power input to the motor is also blocked.

Furthermore, if for some reason the torque of the friction couplings should drop below a given minimum threshold, the traction of the winch element on the slack portion of cable would immediately decrease; and as previously explained, the displacement of rods 30 through the bias of their springs would actuate switches 33 (FIG. 2), switching off the motor and activating the electromagnetic brake.

Summing up, the arrangement described above allows a cleaning or maintenance scaffold to be moved along the outer wall of a building with complete safety by means of simple and reliable apparatus which avoids the risk of damaging the cables. Owing to the capstan made up of pairs of grooved pulleys 4, 5, each cable is connected to the drive shaft of motor 13 in such a way that no slipping is possible as long as a minimum tractive stress is exerted on the slack portion of the cable. Now, this tractive stress exists continuously since the slack portions not only pass over traversing pulleys but also reach reels which are driven by friction couplings on shaft 2. When the scaffold rises, shaft 2 is driven at a speed such that the peripheral speed at the drums of the reels is greater than the speed at which the cable is driven, while during the descent, shaft 2 is locked by the free-wheel coupling, so that it is the cables which pull on the reels to rotate them, and consequently, the tractive stress exerted on the slack portion is subject directly to the friction couplings.

Moreover, sufficient and necessary safety measures are provided: if, for one reason or another, the resistance of the friction couplings should drop below a given threshold, switches 33, mounted on the traverse arms, are thrown and cut off the power supply to the motor. Under these conditions, the normal electromagnetic brake, which causes stopping when the power feed to the motor is interrupted, comes into play and locks shafts 8 and 9. This customary arrangement ensures that the capstans are halted while avoiding any jolting. Since the operating threshold of the safety release is adjusted for a value of the tension on the slack portion which is even higher, by a factor of 2 in any case, than the minimum liable to bring about slipping of the cables on the capstans, it is clearly apparent that this risk of slipping is completely precluded.

In any event, the tension on the slack portion of the cable is therefore indeed continuously monitored, and an immediate and automatic intervention takes place in case of lack of tension on that portion of cable.

What is claimed is:

1. Apparatus for suspending a scaffold or the like, comprising a frame, one or more cables supporting said scaffold, a support to which said cables are connected, a winch made up of one or more pairs of grooved pulleys having parallel axes, a motor having a shaft coupled to said winch for rotating all of said pulleys in the same direction, each of said cables being wound several times over a respective one of said pairs of pulleys and having on one side a taut portion running to said scaffold or to said support and on the other side a slack portion, means for keeping said slack portion under tension, means for monitoring the tension of said slack portion, and winch-locking means connected to said monitoring means, said monitoring means causing said winch locking means to forcibly lock said winch if said slack portion tension falls below a predetermined threshold.

2. Apparatus for suspending a scaffold or the like, comprising a frame, one or more cables supporting said scaffold, a support to which said cables are connected, a winch made up of one or more pairs of grooved pulleys having parallel axes, a motor having a shaft coupled to said winch for rotating all of said pulleys in the same direction, each of said cables being wound several times over a respective one of said pairs of pulleys and having on one side a taut portion running to said scaffold or to said support and on the other side a slack portion, means for keeping said slack portion under tension, a drive shaft and one or more reels mounted on said drive shaft and respectively associated with each of said cables, one end of each said slack portion being attached to a respective reel and said slack portion being wound thereon in several layers when said scaffold is raised, each of said reels being driven in the same direction as said pulleys by said motor when said scaffold is raised and by the traction exerted by said winch when said scaffold is lowered, means for monitoring the tension of each said slack portion, and winch-locking means connected to said monitoring means, said monitoring means causing said winch locking means to forcibly lock said winch if the tension of said slack portion falls below a predetermined threshold.

3. The apparatus of claim 2, further comprising a traverse mechanism associated with each of said reels for distributing said cables in successive layers on said reels, said monitoring means being combined with said traverse mechanism.

4. The apparatus of claim 2, further comprising a driving wheel connected to said motor, said means for keeping said slack portion under tension including a friction coupling disposed between each of said reels and said drive shaft, a monodirectional coupling disposed between said drive shaft and said driving wheel, and a further monodirectional coupling disposed between said drive shaft and said frame, said further monodirectional coupling preventing said drive shaft from rotating in the direction of unwinding of said cables.

5. The apparatus of claim 4, comprising a plurality of said cables, wherein all of said reels are mounted on a single said drive shaft, further comprising a single adjusting means for adjusting said friction couplings disposed between said drive shaft and said reels.

6. The apparatus of claim 5, wherein two or more said cables contain signal conductors, and said winch includes a plurality of said pair of pulleys and said drive shaft bears a plurality of said reels, said apparatus further comprising signalling and control means and two contact rings respectively associated with two of said reels for connecting said signalling and control means to said signal conductors.

7. The apparatus of claim 1, further comprising a supporting shaft bearing one of said pulleys of each said pair, wherein said winch-locking means comprise a centrifugally controlled brake mounted on said shaft and adapted to lock said supporting shaft relative to said frame when a speed in excess of a predetermined limit is reached and an electromagnetic brake mounted on said motor shaft and energized in response to said monitoring means sensing that said tension is below said threshold.

8. The apparatus of claim 7 wherein said monitoring means causes interruption of current to said motor when said tension is below said threshold.

9. The apparatus of claim 7 wherein said centrifugally controlled brake actuates a switch causing interruption of current to said motor when said excess speed is reached.

* * * * *